US006772746B2

(12) United States Patent
Gabrel

(10) Patent No.: US 6,772,746 B2
(45) Date of Patent: Aug. 10, 2004

(54) POWER SAVING ELECTRONIC GUN TRIGGER

(76) Inventor: Stanley Gabrel, 3355 N. Ridge Ave., Arlington Heights, IL (US) 60004-1411

( * ) Notice: Subject to any disclaimer, the term of this patent is extended or adjusted under 35 U.S.C. 154(b) by 0 days.

(21) Appl. No.: 10/695,036

(22) Filed: Oct. 28, 2003

(65) Prior Publication Data

US 2004/0084038 A1 May 6, 2004

Related U.S. Application Data

(60) Provisional application No. 60/421,664, filed on Oct. 28, 2002.

(51) Int. Cl.[7] ..... F41B 11/02
(52) U.S. Cl. ..... 124/32
(58) Field of Search ..... 124/32, 77; 42/84; 89/28.05, 135

(56) References Cited

U.S. PATENT DOCUMENTS

| | | | | | |
|---|---|---|---|---|---|
| 4,960,033 | A | * | 10/1990 | Quantz | 89/28.05 |
| 5,727,538 | A | * | 3/1998 | Ellis | 124/77 |
| 6,516,791 | B2 | * | 2/2003 | Perrone | 124/77 |
| 6,523,534 | B2 | * | 2/2003 | Juan | 124/32 |
| 6,694,963 | B1 | * | 2/2004 | Taylor | 124/32 |

* cited by examiner

*Primary Examiner*—John A. Ricci
(74) *Attorney, Agent, or Firm*—IP Focus Law Group, Ltd.

(57) ABSTRACT

An electronic trigger grip for a paintball gun having a firing actuator is described. The grip subassembly includes a frame adapted for mounting to the gun, a trigger movably secured to the frame, a sensor positioned to detect a pull of the trigger, a linear motor adapted for mechanical coupled to the firing actuator, and a source of electric power. A pulsation power controller is electrically connected to the sensor, the power source and the linear motor for energizing the linear motor with a pulsating signal in response to a trigger pull.

20 Claims, 4 Drawing Sheets

POWER SAVING ELECTRONIC GUN TRIGGER

CROSS-REFERENCE TO RELATED APPLICATION

This application claims priority from U.S. Provisional Applications for Ser. No. 60/421,664 filed on Oct. 28, 2002.

FIELD OF THE INVENTION

This invention relates to an electronic trigger for a paintball marking gun, and more particularly to an electronic trigger having power saving features for improved battery life.

BACKGROUND OF THE INVENTION

Paintball marking guns are used in a variety of targeting and simulated battle games (e.g. capture the flag). These guns launch a ball of paint with a frangible shell that is designed to hold the ball shape until striking an object after firing. Upon striking the object, the ball is set to break open leaving a paint spot.

Paint-ball guns typically employ a firing system powered by compressed gas such as air. Compressed air is supplied from a supply tank which is mounted to or carried with the gun. The gun systems are equipped with pressure regulators which receive gas from the tank at a relatively high pressure and deliver gas at a reduced, more consistent pressure for propelling the paintball.

Paintball guns had traditionally been equipped with manual trigger mechanism to control the release of compressed gas. The trigger mechanism serves to transfer a finger pull at the trigger to the rapid cycling of a gas valve.

Although manual trigger systems typically include some application of mechanical advantage (e.g. leverage), the required hand, or finger, force is known to interfere with gun targeting. A forceful trigger pull may cause the shooter to move the entire paintball gun thereby changing the aim just before firing. Likewise, rapid firing of a manual trigger mechanism stresses and tires the shooter's hands and fingers.

Paintball guns have been equipped with power-assisted trigger mechanisms requiring only a slight pulling force in an effort to reduce undesired gun movement and shooter fatigue. Conventional power-assisted trigger mechanisms include a switch activated solenoid with battery power. A serious drawback of these available powered trigger systems is limited battery life.

Limited battery life is a particular problem for paintball guns which require a mechanical hold after firing. A popular paintball gun design sold under the commercial designation "Autococker 2000" (Warr Game Products, Sante Fe Springs, Calif.) requires such a hold from the trigger in order to release a new paintball into the firing chamber.

What is needed is a power-assisted trigger mechanism suitable for use with paintball guns offering increased battery life and advanced features.

SUMMARY OF THE INVENTION

A grip suitable for triggering a firing actuator of a gun comprises a frame adapted for mounting to the gun, a trigger movably secured to the frame, a sensor positioned to detect a pull of the trigger, a linear motor adapted for mechanical coupling to the firing actuator, and a source of electric power. A pulsation power controller is electrically connected to the sensor, the power source and the linear motor for energizing the linear motor with a pulsating signal in response to a trigger pull.

The pulsation power controller preferably includes a switch in the circuit connecting the linear motor to the power source and an oscillating signal generator connected to control the operation of the switch in response to a signal from the trigger pull sensor.

BRIEF DESCRIPTION OF THE DRAWINGS

In the accompanying drawings that form part of the specification like numerals are employed to designate like parts throughout the same.

DESCRIPTION OF THE PREFERRED EMBODIMENTS

Figure 1:
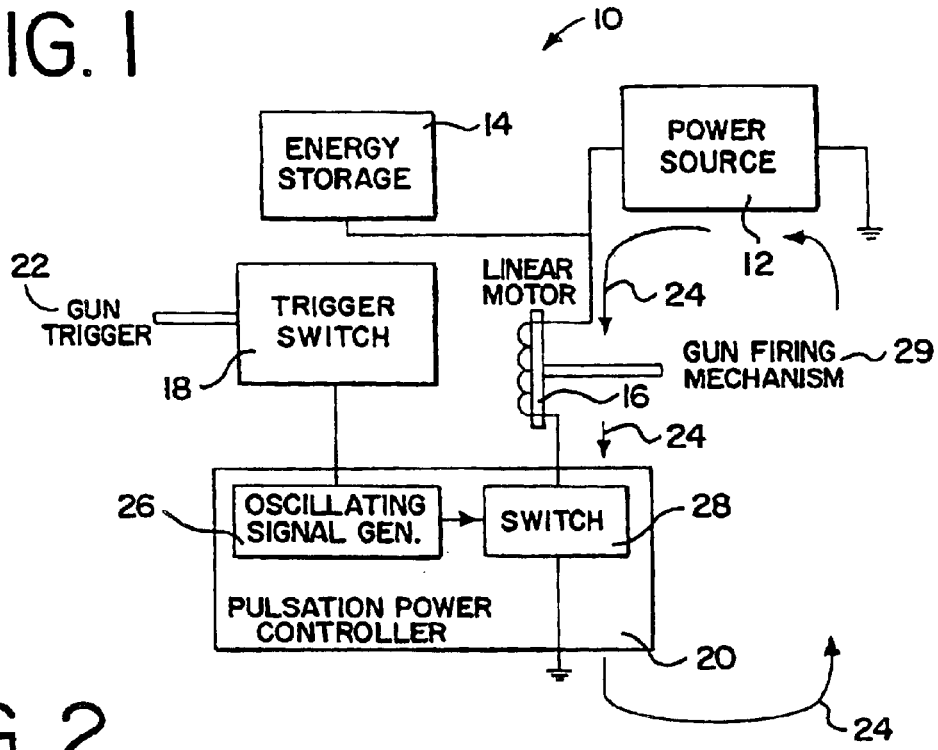
FIG. 1 is a block diagram illustrating major elements of a power assisted trigger mechanism according to the present invention.

The invention disclosed herein is, of course, susceptible of embodiment in may different forms. Shown in the drawings and described hereinbelow in detail are preferred embodiments of the invention. It is to be understood, however, that the present disclosure is an exemplification of the principles of the invention and does not limit the invention to the illustrated embodiments.

In the accompanying drawings that form part of the specification like numerals are employed to designate like parts throughout the same.

FIG. 1 is a block diagram illustrating major elements of a power assisted trigger mechanism 10 according to the present invention. Trigger mechanism 10 includes a power source 12, a low-resistance energy trap 14 (e.g. a capacitor), a linear motor 16, a trigger sensor (or switch) 18 and a pulsation power controller 20.

Trigger sensor (or switch) 18 is positioned to detect a pull of gun trigger 22. Pulsation power controller 20 is operably linked to trigger sensor 18 and the power circuit 24 of linear motor 16. More specifically, pulsation power controller 20 has an oscillating signal generator 26 and a switch 28 in power circuit 24.

Power circuit 24 is made up by power source 24 (e.g. a battery), a low-resistance energy trap 14, linear motor 16 and power switch 28.

In operation a pull of trigger 22 is detected by sensor 18 and communicated to pulsation power controller 20. In response, pulsation power controller 20 actuates switch 28 with an oscillating signal to rapidly open and close power circuit 24. This oscillating actuation of switch 28 creates an oscillating (or pulsating) power signal in power circuit 24, i.e. running through energy trap 14, linear motor 16 and power source 12 (as needed).

In a preferred embodiment, pulsation power controller 20 is programmed to respond to a trigger pull by actuating switch 28 for a predetermined period (e.g. 50–60 milliseconds) using a varying frequency signal.

Figure 2:
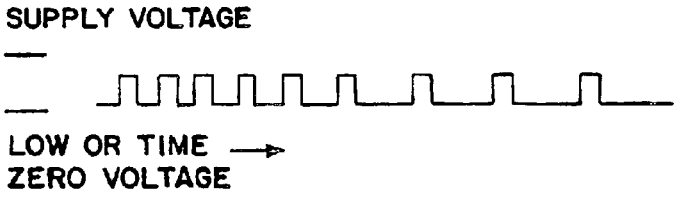
FIG. 2 shows an exemplary power signal profile for power assisted trigger mechanisms according to the present invention.

Most preferred is an activation signal with a decreasing frequency over the period. A decreasing frequency has been found to be especially energy conserving. By starting the power signal at high frequency, linear motor 16 is supplied with sufficient energy for a relatively high-force activation of a spring loaded gun firing mechanism 29. After linear motor 16 has moved its mechanical mechanism, relatively less energy is required for the remaining mechanical hold. FIG. 2 shows an exemplary power signal profile. As illustrated, controller 20 preferably supplies a digital pulse type oscillating signal.

Trigger mechanism 10 preferably includes a low-resistance energy store (or trap) 14 to reduce energy loss through power source 12. Before a trigger pull, trap 14 is charged by power source 12 to provide a supply of energy available at relatively lower resistance than power source 12. This energy trap features allows power circuit 24 to activate linear motor 16 for a predetermined period using less energy directly flowing from power source 12 at high resistance thereby increasing energy efficiency. After each solenoid activation period, energy trap 14 is recharged at a relatively slow rate, i.e. low current, such that less energy is lost to resistance in power source 12.

Figure 3:
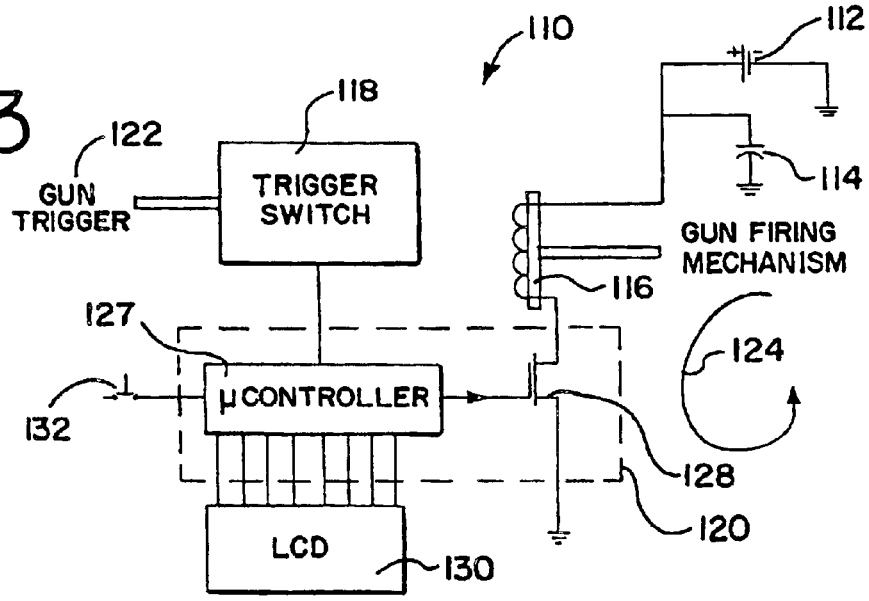
FIG. 3 is a block-style circuit diagram illustrating preferred components for a power-assisted trigger mechanism.

FIG. 3 is a block-style circuit diagram illustrating preferred components for a power-assisted trigger mechanism according to the present invention. Power-assisted trigger mechanism 110 includes a battery 112, a discrete capacitor 114 (to serve as energy store), a linear motor in the form of a solenoid 116, a power switch in the form of a MOSFET 128, a microcontroller IC 127, a display 130, and a trigger switch 118.

As illustrated, microcontroller 127 and MOSFET switch 128 provide the functions of a pulsation power controller, which is identified in FIG. 3 with reference number 120.

In operation a pull of trigger 122 is detected by sensor 118 and communicated to microcontroller 127. In response; microcontroller 127 actuates MOSFET switch 128 with an oscillating signal to rapidly open and close a power circuit 124 for solenoid 116. This oscillating actuation of MOSFET switch 128 creates an oscillating (or pulsating) power signal in power circuit 124, i.e. running through capacitor 114, linear motor 116, and battery 112 (as needed).

Pushbuttons for operator communication to microcontroller 127 are symbolically represented in FIG. 2 by reference number 132.

Figure 4:
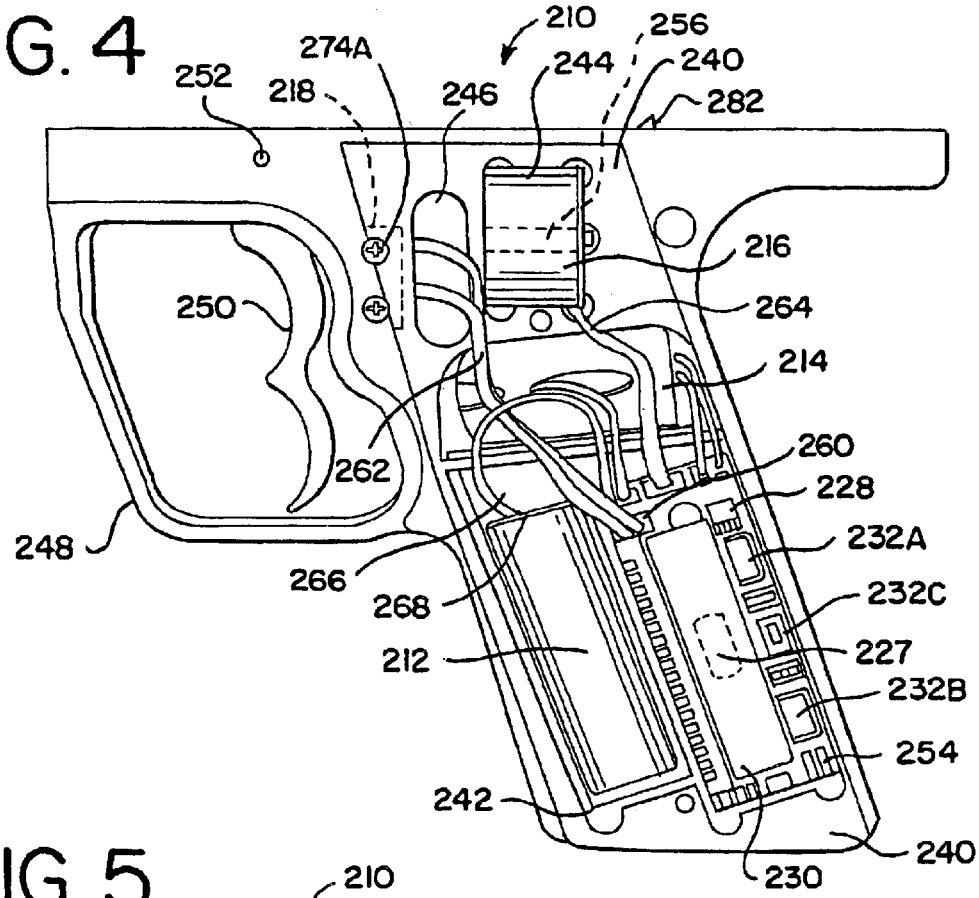
FIG. 4 is a side view of a gun grip subassembly fabricated according to block circuit diagrams of FIGS. 1 and 3 and the graph of FIG. 2.

FIG. 4 is a side view of a gun grip subassembly 210 fabricated according to block circuit diagrams of FIGS. 1 and 3 and the graph of FIG. 2. Subassembly 210 is shown with its cover removed to reveal internal details. Grip 210 includes a grip frame 240 having a lower cavity 242, upper cavities 244 and 246, and a trigger guard 248. A two-finger trigger 250 is movably mounted to frame 240 with a pin 252.

Lower cavity 240 houses a power source in the form of a battery 212, a printed circuit board (PCB) 254 and a capacitor 214. Upper cavity 246 houses a trigger sensor 218 (FIG. 7) and upper cavity 244 houses a linear motor in the form of a solenoid 216. Solenoid 216 includes a plunger 256 which is positioned to mechanically actuate a spring loaded lever mechanism 258 (FIG. 6) which is adapted to engage a gun sear (not separately shown).

PCB 254 supports a liquid crystal display (LCD) 230, a microcontroller 227 mounted to PCB 254 under LCD 230, pushbuttons 232A, 232B and 232C for gun operator inputs to microcontroller 227, and connector sockets 260. Sockets 260 are provided to connect wiring 262 to the trigger sensor 218, wiring 264 to solenoid 216 and wiring 266 to a battery connector 268 for battery 212. Capacitor 214 is hard-wired to PCB 254. PCB 254 interconnects trigger sensor 218, solenoid 216, battery 212, capacitor 214 and microcontroller 227.

Microcontroller 227 is preferably an IC commercially available from Microchip Technology, Inc. (Chandler, Ariz.) under the designation PIC16C924-04. Trigger sensor 218 is positioned within an inner cavity of frame 240 and as such is better illustrated in FIG. 7. Sensor 218 is preferably a contact sensor commercially available from Saia-Burgess, Inc. under the designation "BURGESS X4F303K1AA." Battery 212 is preferably a standard 9 volt power cell and capacitor 214 is preferably a 6800 microfarads discrete capacitor.

Figure 5:
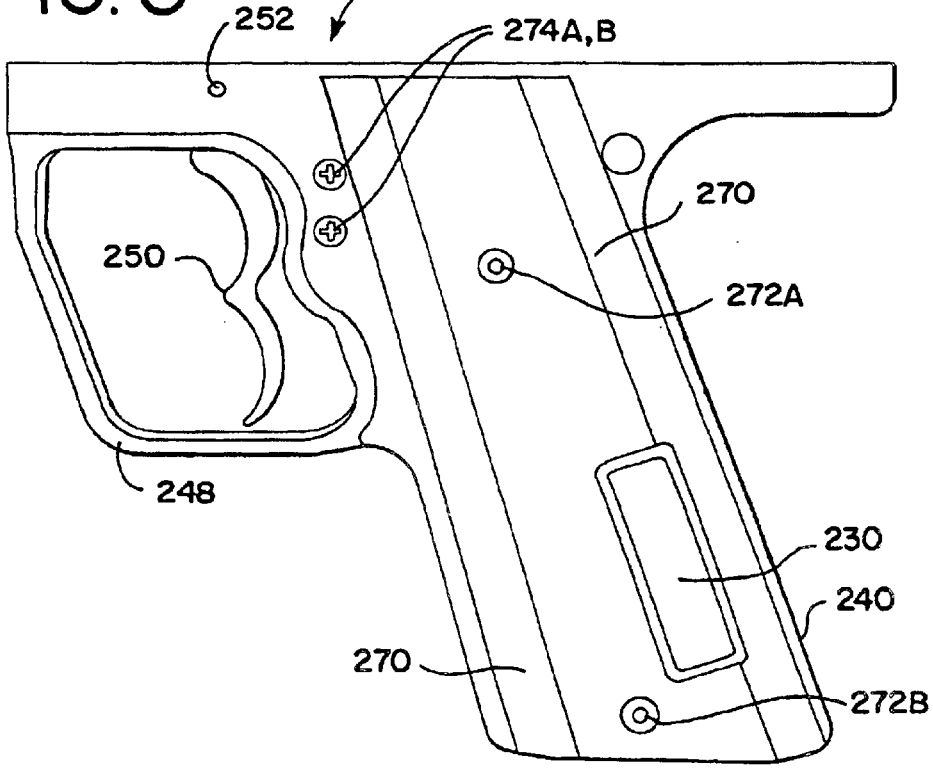
FIG. 5 is a side view of the grip subassembly a cover.

FIG. 5 is a side view of grip subassembly 210 with a cover 270 in place. Cover 270 is secured to frame 240 with screws 272A and 272B. Trigger sensor 218 is secured to frame 254 with screws 274A and 274B.

Figure 6:
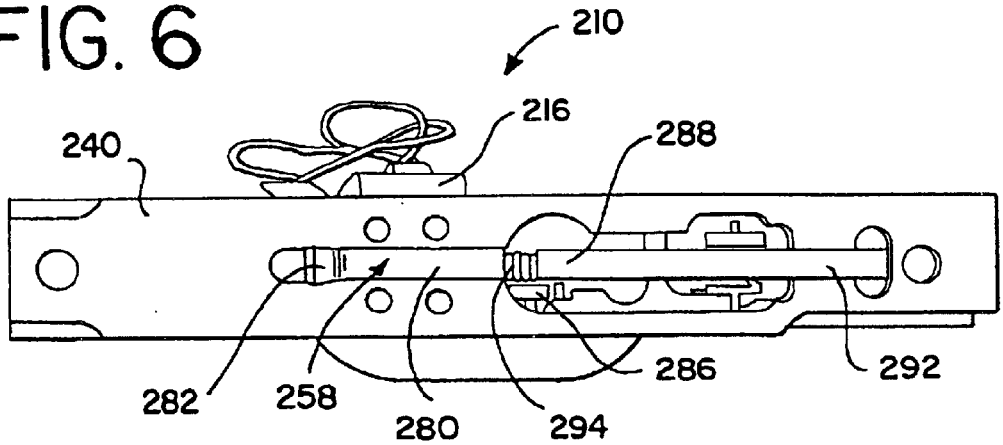
FIG. 6 is a top view of the grip subassembly showing details of the mechanical coupling elements.

FIG. 6 is a top view of grip subassembly 210 showing details of the mechanical coupling elements 258 linked to the firing mechanism of a paintball gun. Grip subassembly 210 was specifically prepared for mounting and linking to the body of an "Autococker"-style paintball gun as is commercially available from Warr Game Products, Sante Fe Springs, Calif.

As noted above, the "Autococker" requires a hold period from the trigger mechanism. Accordingly, the microcontroller 227 is preferably programmed to provide an oscillating power signal to solenoid 216 for a period of about 50 to 60 milliseconds. The oscillating signal preferably has a decreasing frequency as shown in FIG. 2. Preferably the pulse frequency decreases from greater than about 1 kilohertz to less than about 1 kilohertz. This decreasing frequency signal allows solenoid 216 to overcome an initial-resistance of about 2 to about 4pounds force but still reduce energy usage during the post firing hold period.

Figure 7:
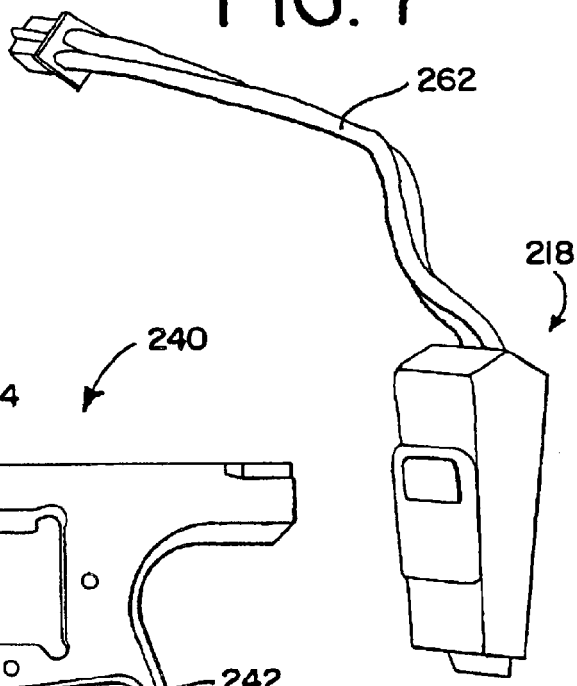
FIG. 7 is a perspective view of a preferred trigger sensor.
Figure 8:
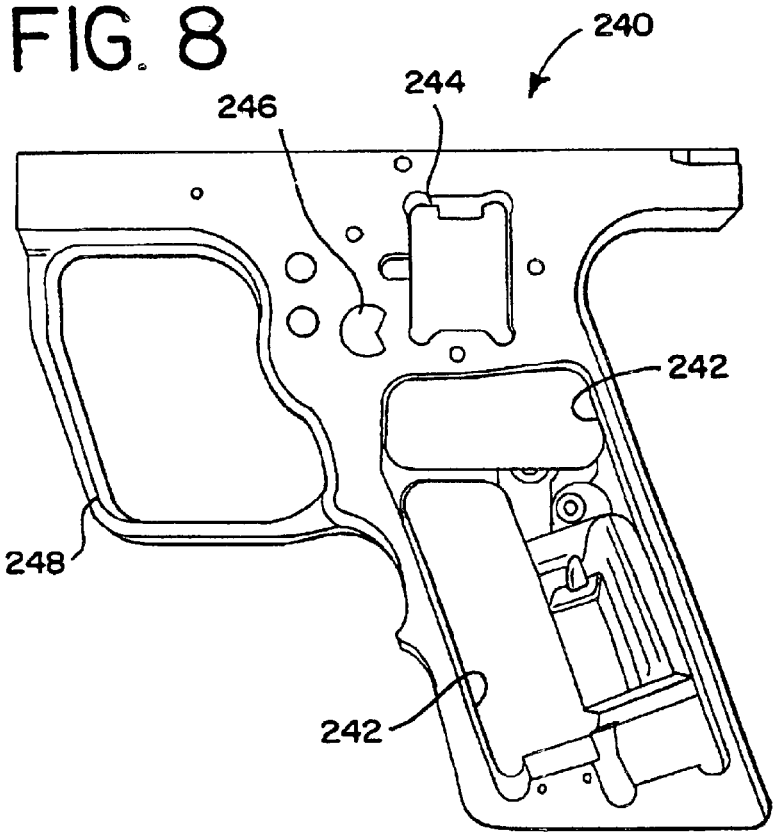
FIG. 8 is a side view of gun grip frame with components removed to show internal cavities.
Figure 9:
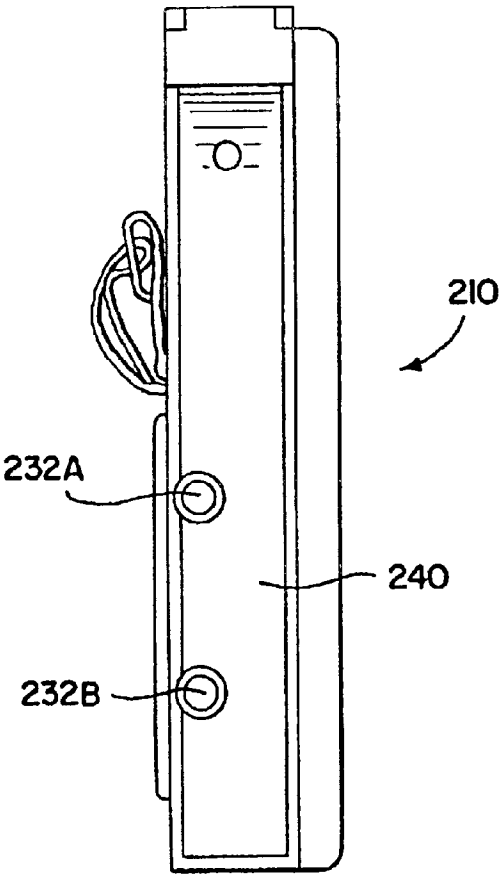
FIG. 9 is a back side view of the grip subassembly showing pushbuttons.

FIG. 7 is a perspective view of a preferred trigger sensor 218. FIG. 8 is a side view of frame 240 with components removed to show internal cavities. FIG. 9 is a back side view of grip subassembly 210 showing pushbuttons 232A and 232B.

Figure 10:
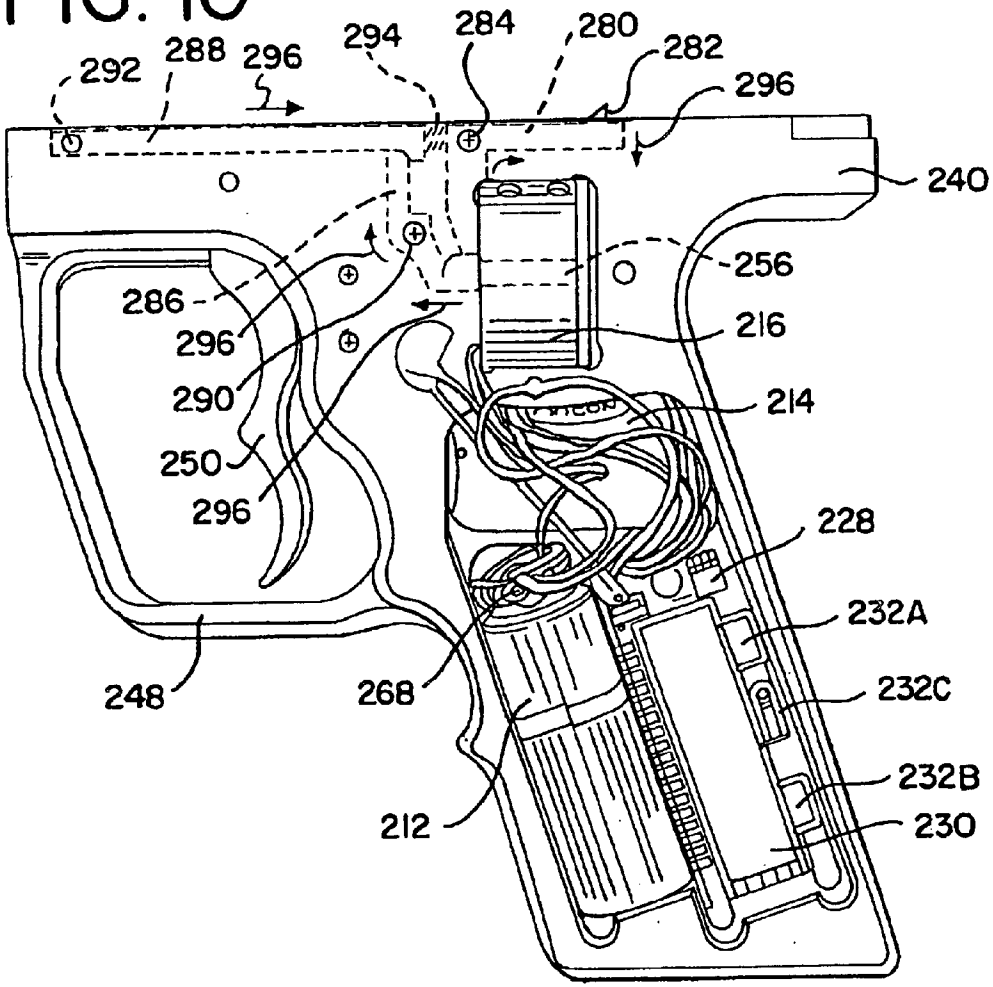
FIG. 10 is an alternate side view of the grip subassembly illustrating hidden components of the lever mechanist for engaging the firing mechanism of a paintball gun.

FIG. 10 is an alternate side view of grip subassembly 210 illustrating hidden components of lever mechanism 258, which is configured for engaging the firing mechanism of an Autococker paintball gun. Lever mechanism 258 includes a shaped lever 280 having a protrusion 282. Lever 280 is mounted within frame 240 using pin 284 such that its lower portion can be pushed by plunger 256 of solenoid 216. A second lever 286 is provided to engage first lever 280 and pull a sliding link 288. Second lever 286 is mounted to frame 240 with pin 290. Sliding link 288 includes an opening 292 for receiving a linkage (not shown) to a gas valve on the Autococker paintball gun. Sliding link is biased against first lever 280 with a spring 294. A set of directional arrows 296 show the movement of the lever mechanism elements in response to activation of solenoid 216.

A wide variety of conventional materials are suitable for making the frame and mechanical linking components of trigger subassemblies embodying the present invention. These materials include metals, notably aluminum and steels, and various high-strength composites without limitation that all or any of the elements be made of the same material. Frame 240 is preferably an aluminum alloy (e.g., 6061-T6) or a stainless steel (e.g. 302–304 or 316. The material of construction for cover 270 is preferably a rigid plastic.

The foregoing specification and drawings are to be taken as illustrative but not limiting of the present invention. Still other configurations and embodiments utilizing the spirit and scope of the present invention are possible, and will readily present themselves to those skilled in the art.

I claim:

1. A grip suitable for triggering a firing actuator of a gun, the grip comprising:

a frame adapted for mounting to the gun;

a trigger movably secured to said frame;

a sensor positioned to detect a pull of said trigger;

a linear motor adapted for mechanical coupling to said firing actuator;

a source of electric power;

a pulsation power controller electrically connected to said sensor, said power source and said linear motor for energizing said linear motor with a pulsating signal in response to a trigger pull.

2. The grip according to claim 1 wherein said linear motor is a solenoid.

3. The grip according to claim 1 wherein said pulsation power controller includes a switch in a circuit connecting said linear motor to said power source and an oscillating signal generator connected to control the operation of said switch.

4. The grip according to claim 3 wherein said switch is a MOSFET transistor.

5. The grip according to claim 3 wherein said oscillating signal generator is resident on a microcontroller integrated circuit.

6. The grip according to claim 1 further comprising a low-resistance energy trap in a circuit connecting said power source to said linear motor.

7. The grip according to claim 6 wherein said low-resistance energy trap is a discrete capacitor.

8. The grip according to claim 1 wherein said pulsation power controller includes an adjustable frequency output.

9. The grip according to claim 1 wherein said source of electric power is a battery.

10. A power-assisted gun trigger subassembly suitable for mounting to a gun having a mechanical firing mechanism, the subassembly comprising:

a grip frame;

a trigger movably secured to said grip frame;

a trigger sensor secured to said grip frame and responsive to movement of said trigger;

a solenoid adapted for coupling to said firing mechanism;

a battery connector for providing a source of electrical energy;

a pulsation power controller connected to said solenoid, said trigger sensor and said battery connector.

11. The grip according to claim 10 wherein said pulsation power controller includes a switch in a circuit connecting said solenoid to said battery connector and an oscillating signal generator connected to control the operation of said switch.

12. The grip according to claim 11 wherein said switch is a MOSFET transistor.

13. The grip according to claim 11 wherein said oscillating signal generator is resident on a microcontroller integrated circuit.

14. The grip according to claim 10 further comprising a capacitor in a circuit connecting said battery connector to said solenoid.

15. A power-assisted gun trigger subassembly suitable for mounting to a gun having a trigger and a mechanical firing mechanism:

a solenoid adapted for coupling to said firing mechanism;

a trigger sensor responsive to movement of the trigger;

a battery;

a circuit connecting said battery to said solenoid;

a switch in said circuit for controllably opening and closing said circuit;

a capacitor in said circuit;

an oscillating signal generator connected to said trigger sensor and said switch for cycling said switch in response to movement of the trigger.

16. The grip according to claim 15 wherein said oscillating signal generator is resident on a microcontroller integrated circuit.

17. A method for triggering a gun having a trigger, a trigger pull sensor and a mechanical firing actuator linked to a solenoid, the method comprising:

detecting a trigger pull with said trigger pull sensor;

energizing said solenoid with an oscillating power signal when said trigger pull is detected.

18. The method according to claim 17 wherein said step of energizing said solenoid includes applying a varying frequency oscillating signal.

19. The method according to claim 17 wherein said step of energizing said solenoid includes applying a oscillating signal having a decreasing frequency.

20. The method according to claim 17 further comprising the step of storing energy from said battery in a capacitor before detecting said trigger pull.

* * * * *